US008136183B1

(12) United States Patent
Jannetides

(10) Patent No.: US 8,136,183 B1
(45) Date of Patent: Mar. 20, 2012

(54) MODULAR MULTIPLE BED UNIT

(75) Inventor: James N. Jannetides, Fishers, IN (US)

(73) Assignee: J Squared, Inc., Greenfield, IN (US)

( * ) Notice: Subject to any disclaimer, the term of this patent is extended or adjusted under 35 U.S.C. 154(b) by 0 days.

(21) Appl. No.: 11/214,219

(22) Filed: Aug. 29, 2005

(51) Int. Cl.
*A47C 19/00* (2006.01)
*A47C 23/00* (2006.01)
*A47D 7/00* (2006.01)

(52) U.S. Cl. ..... 5/282.1; 5/296; 5/288; 5/9.1

(58) Field of Classification Search ..... 5/8, 9.1, 5/2.1, 280, 288, 289, 296, 299, 304, 282.1; 403/353
See application file for complete search history.

(56) References Cited

U.S. PATENT DOCUMENTS 2,160,174 A * 5/1939 Scalera ..... 5/296
3,011,180 A 12/1961 Majeski
3,316,564 A 5/1967 Rogers
3,760,437 A * 9/1973 Hooker ..... 5/201
4,109,328 A 8/1978 Mason
4,232,411 A 11/1980 Speyer
5,540,491 A 7/1996 Wu
5,572,751 A 11/1996 Brandt
D401,839 S 12/1998 Krey et al.
6,018,829 A 2/2000 Rosenquist
6,349,435 B1 2/2002 Mitchell
6,568,001 B2 5/2003 Walsh
2005/0273929 A1 * 12/2005 Hennings et al. ..... 5/201

OTHER PUBLICATIONS

Dormitory Bed, undated; photographs taken at Miami University Nov. 6, 2005 (2 pages).

* cited by examiner

*Primary Examiner* — Jonathan Liu
(74) *Attorney, Agent, or Firm* — William F. Bahret

(57) ABSTRACT

A modular multiple bed unit having first and second beds connected together at right angles using mating rail brackets each defining a quick-release coupler. A bracket with quick-release coupler is provided at each of the two spaced locations on the side of one rail of the first bed, and a bracket with a mating quick-release coupler is provided on the end of each rail of the second bed for perpendicular connection of the rails of the second bed to the one rail of the first bed. In one embodiment, a stud is formed on each bracket on the rail of the first bed to engage a hook on an L-shaped bracket on the end of a corresponding rail of the second bed.

28 Claims, 9 Drawing Sheets

MODULAR MULTIPLE BED UNIT

BACKGROUND OF THE INVENTION

This invention relates to bed frames and supports, and more particularly to modular multiple bed units.

In dorm rooms and other dwelling rooms having limited floor space in which more than one bed is to be placed, it is known to provide loft beds to elevate the mattresses above head level, thereby freeing valuable floor space for other purposes. Examples of such prior art loft beds are shown in U.S. Pat. Nos. 6,568,001 to Walsh and 6,018,829 to Rosenquist. It is also known to connect beds together at right angles at different levels, with one bed overlapping another, as shown, for example, in U.S. Pat. Nos. 5,572,751 to Brandt and 3,011,180 to Majeski.

SUMMARY OF THE INVENTION

One aspect of the present invention involves, in one embodiment, a multiple bed unit bed rail having a bracket affixed to one side. The bracket has a coupler and a channel portion for receiving a guard rail end.

Another aspect of the present invention involves a modular bed unit including a first elongate bed rail having a male quick-release coupler extending laterally from a side of the bed rail. A second elongate bed rail is adapted to be connected perpendicular to the first elongate bed rail at substantially the same elevation. The second elongate bed rail has a female quick-release coupler on one end for releasably engaging the male quick-release coupler on the side of the first elongate bed rail.

Yet another aspect of the present invention involves a modular multiple bed unit including a first bed having a first pair of bed ends and a pair of bed rails connected between and supported by the bed ends. A bracket having a coupler is affixed to a side of one of the bed rails. A second bed with a third bed end and a second pair of bed rails has one of the bed rails connected to the third bed end and perpendicularly connected to the bracket at substantially the same elevation by a second coupler for engaging said coupler.

A further aspect of the present invention involves a modular bed unit including a first elongate bed rail with a bracket affixed to a side. The bracket has a first quick-release coupler. A second elongated bed rail adapted to be connected perpendicularly to the first elongate bed rail has a second quick-release coupler for releasably engaging the first quick release coupler.

Other aspects and advantages of the present invention will be apparent from the following descriptions with reference to the drawings.

DETAILED DESCRIPTION OF THE PREFERRED EMBODIMENTS

Figure 1:
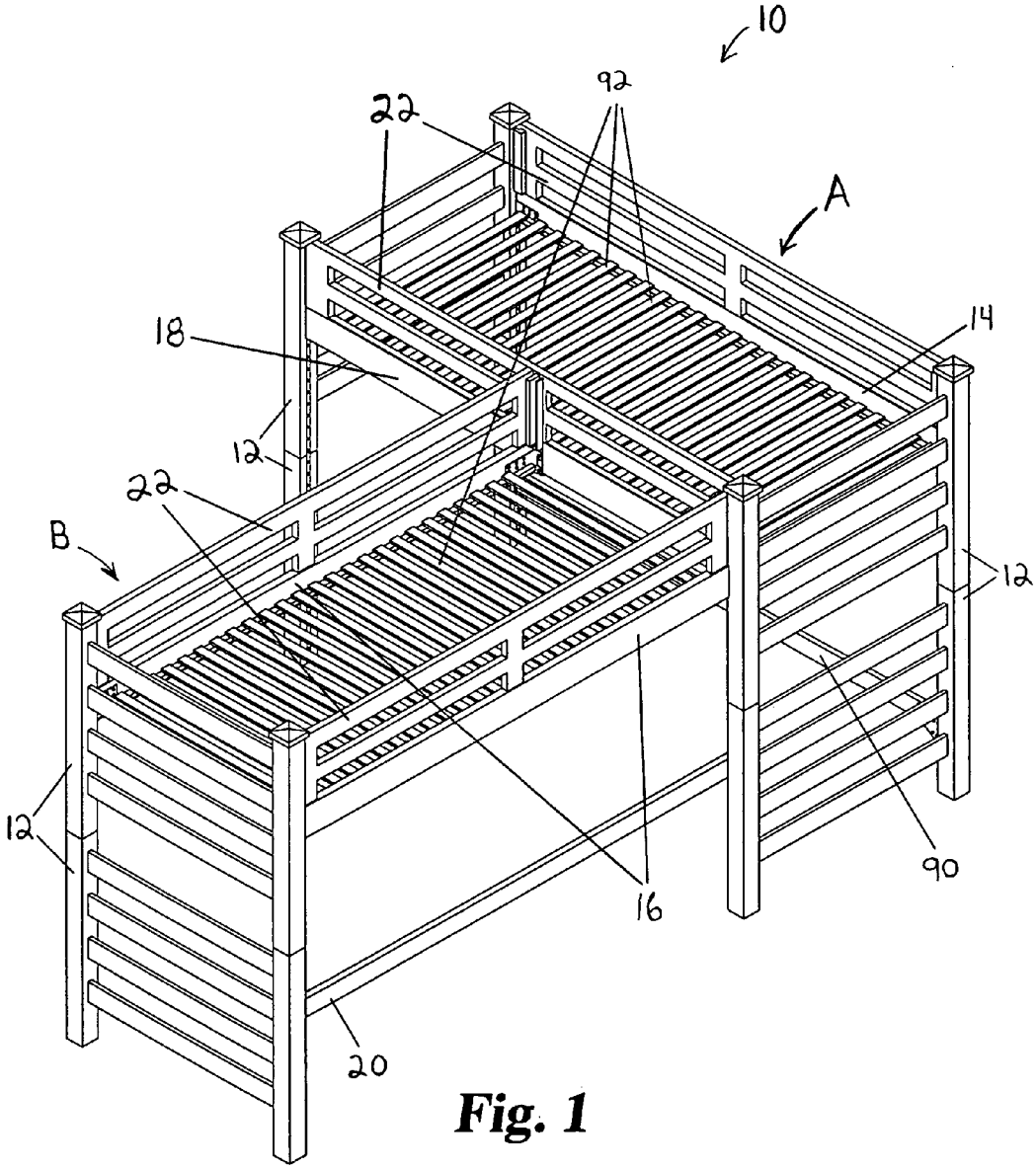
FIG. 1 is a perspective view of one embodiment of an assembled multiple bed unit according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIG. 1 illustrates one embodiment of a modular multiple bed unit or loft bed 10 according to the present invention. Loft bed 10 is assembled from modular components of different types that may be interconnected in a variety of arrangements, of which loft bed 10 is only one example. The modular components, as show in the exploded perspective view of FIG. 2, generally include bed ends 12, a bed rail with straight hook plates 14, bed rails with L-shaped hook plates 16, a bed rail with support brackets 18, a stabilizer rail 20, and guard rails 22.

Figure 3:
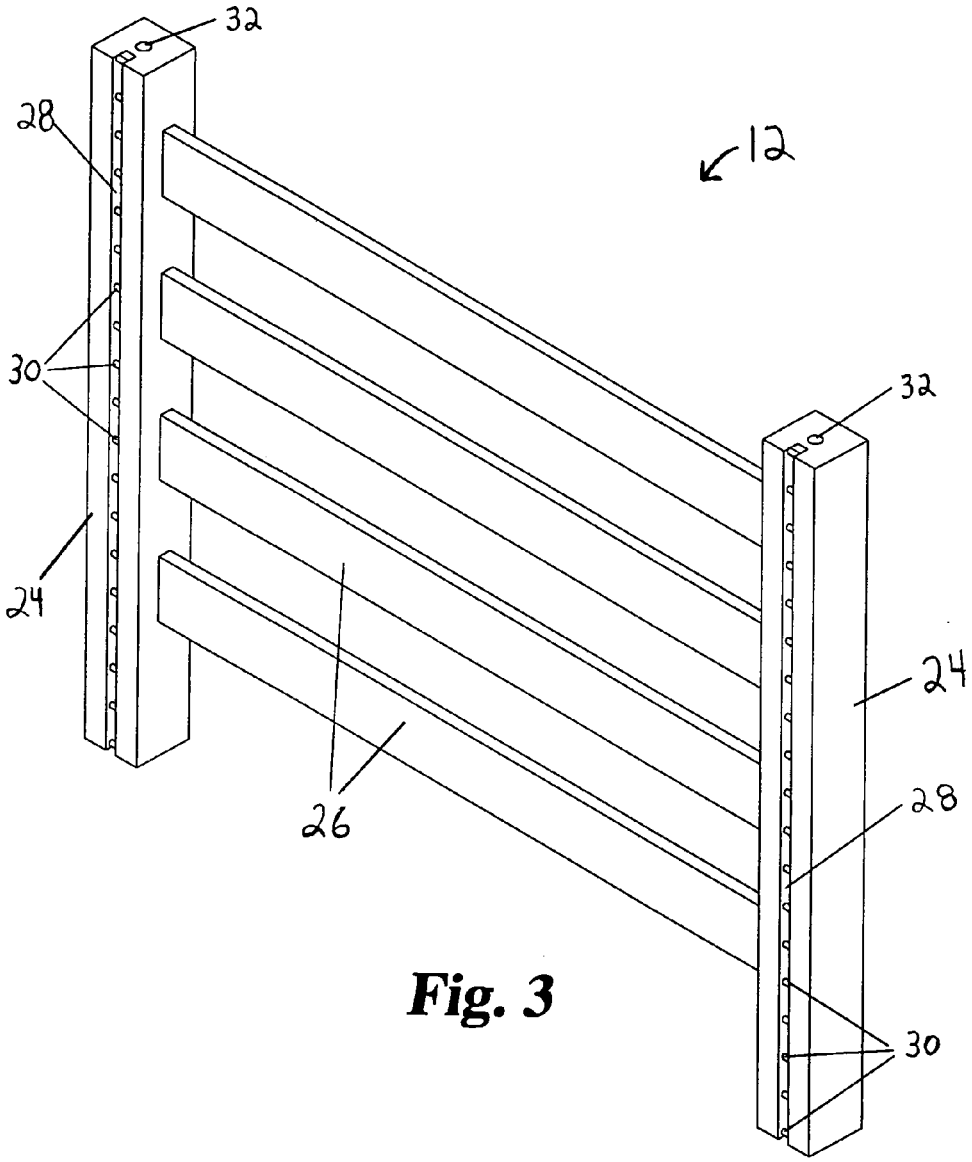
FIG. 3 is a perspective view of a bed end of FIG. 1

FIG. 3 shows a perspective view of the bed ends 12 used in the loft bed 10. Each bed end 12 includes a pair of spaced, substantially vertical posts 24, and a plurality of substantially horizontal cross-pieces 26. Each post 24 has a longitudinal slot 28 in one face running substantially the length thereof, with the slotted faces of both posts 24 of a given bed end 12 facing in the same direction. A plurality of metal cross-pins 30 are spaced vertically at substantially even intervals and extend substantially horizontally, bridging across the slots 28. The slots 28 and cross-pins 30 comprise a rail connector for receiving a hook plate of a rail as described below. A dowel-hole 32 is provided in each end of the vertical posts 24 for receiving a dowel therein to facilitate stacking of bed ends 12.

Figure 4:
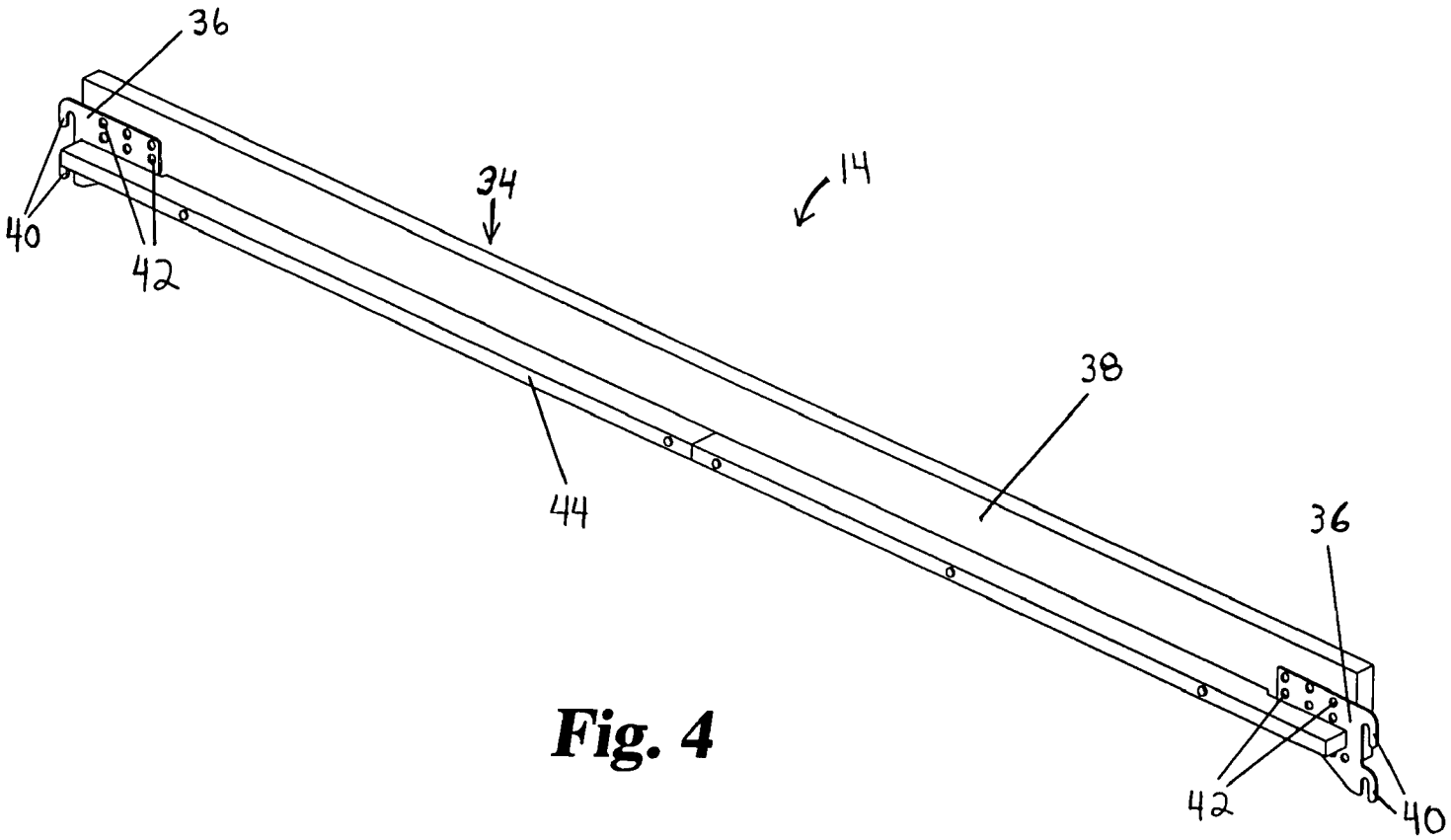
FIG. 4 is a perspective view of a bed rail of FIG. 1.

FIG. 4 shows a perspective view of the bed rail with straight hook plates 14 on each end thereof. Bed rail 14 includes an elongate rail member 34 that may be made of wood about one inch wide by about 5 inches tall, with a length appropriate to accommodate a mattress of standard dimensions. Each straight hook plate 36 is affixed to the inboard face 38 of rail member 34 and has a pair of spaced, downward-opening hooks 40 that may engage the cross-pins 30 in the slots 28 of the bed ends 12 as shown in FIG. 1. The straight hook plates 36 are preferably made of metal and are attached to the wooden rail member 34 by screw fasteners, preferably by way of a plurality of pan-head machine screws 42 received through corresponding holes in the straight hook-plates 36 and threadedly received in threaded inserts embedded in corresponding holes in the rail member 34. Alternatively, wood screws or other suitable fasteners may be employed. An elongate support lip 44 is affixed with pan head wood screws 46 to the inboard face 38 of rail member 34 and runs substantially the length thereof to support deck slats. The support lip 44 overlies the straight hook-plates 36 and is rabbeted at each end to accommodate the thickness of the plates 36.

Figure 2:
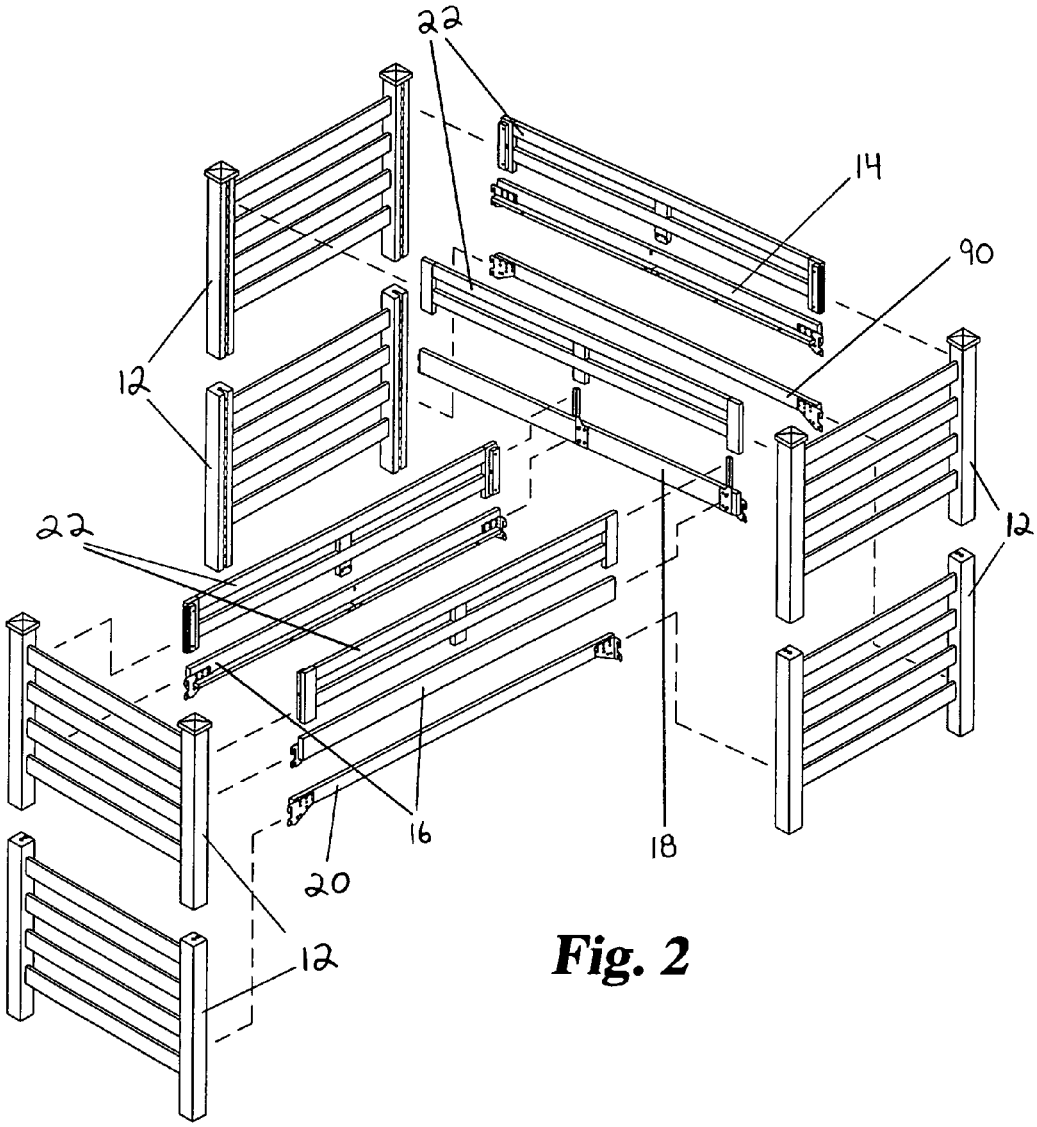
FIG. 2 is an exploded perspective view of the bed unit of FIG. 1.
Figure 5:
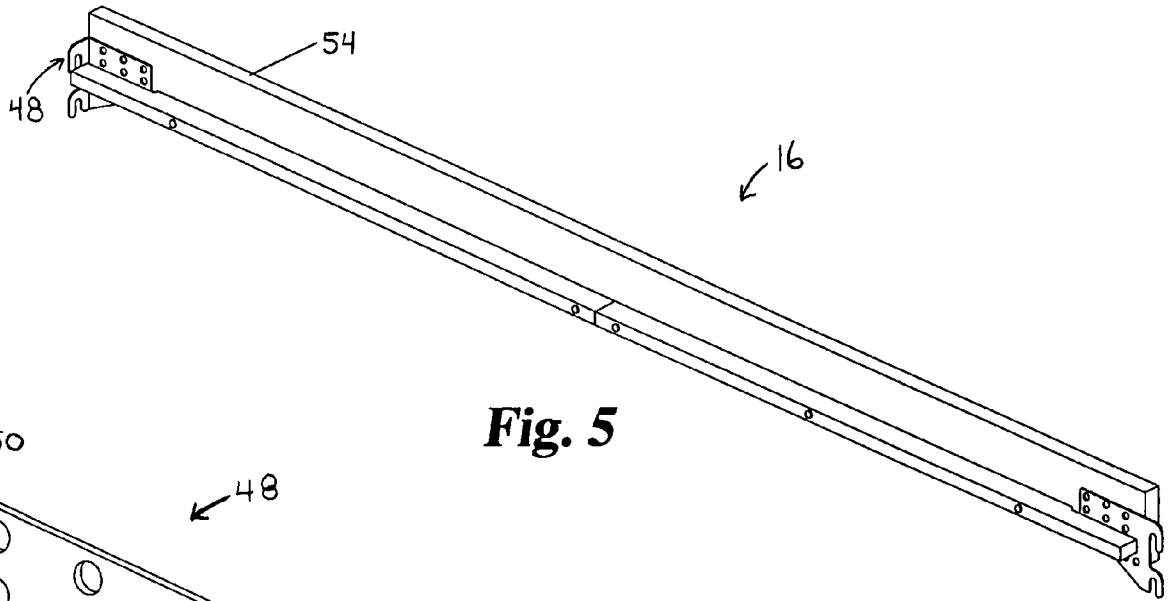
FIG. 5 is a perspective view of another bed rail of FIG. 1.
Figure 6:
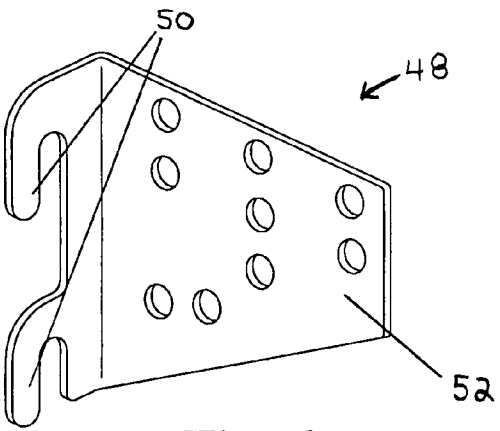
FIG. 6 is a perspective view of the L-shaped hook plate of FIG. 5.

Bed rails 16, shown in FIGS. 1, 2 and 5, are similar in construction to bed rail 14, except that they have couplers 48, such as female coupler L-shaped or right-angle hook plates, at one end. The L-shaped hook plates 48, as individually shown in FIG. 6, are preferably formed from metal with the spaced, downwardly-opening hooks 50 extending outwardly at a right angle from the remainder of the plate 52 that is connected to the elongate rail member 54. The L-shaped hook plates 48 allow the bed rails 16 to be perpendicularly connected to bed rail 18 at substantially the same elevation, forming a modular multiple bed unit 10 with a generally L-shaped configuration, as shown in FIG. 1.

Figure 7:
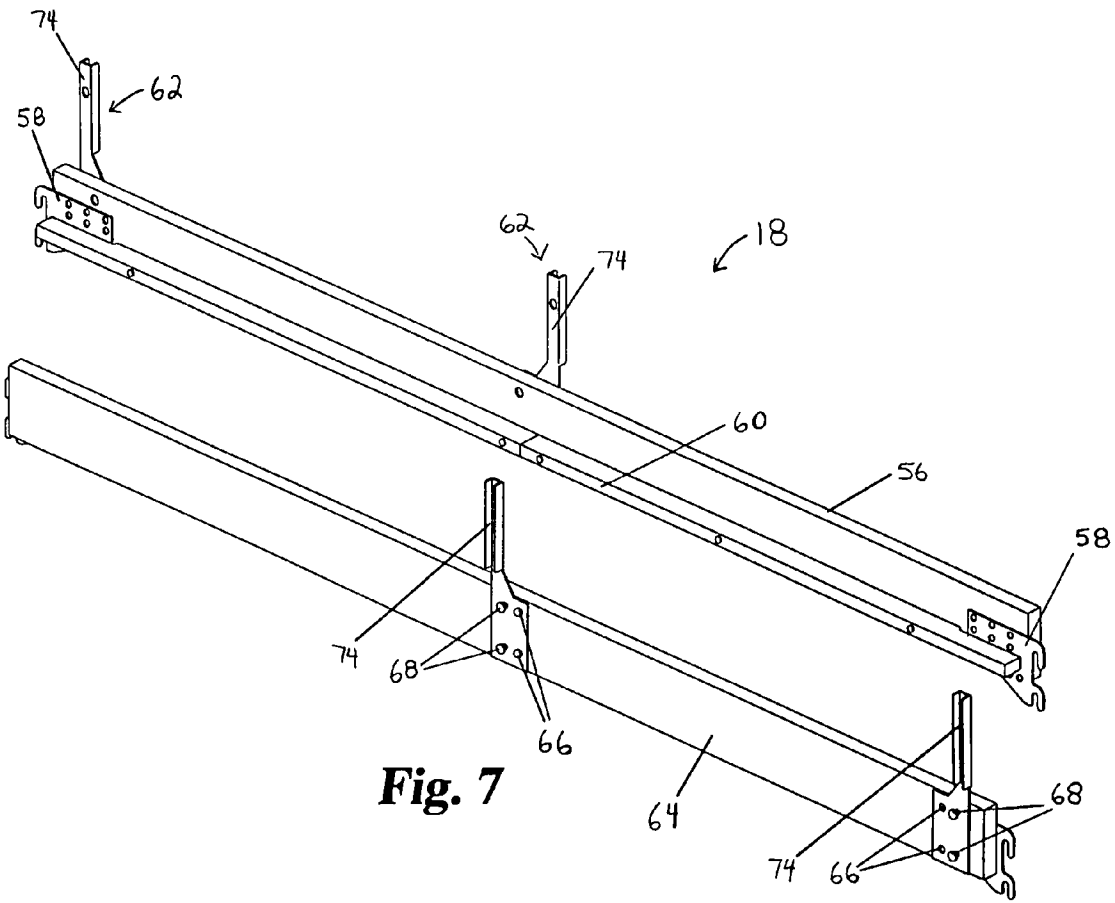
FIG. 7 shows perspective views of the bed rail with support brackets of FIG. 1.
Figure 8:
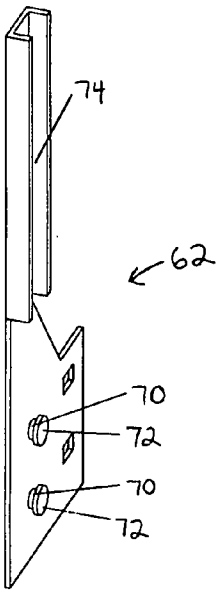
FIG. 8 is a perspective view of the support bracket of FIG. 7.
Figure 9:
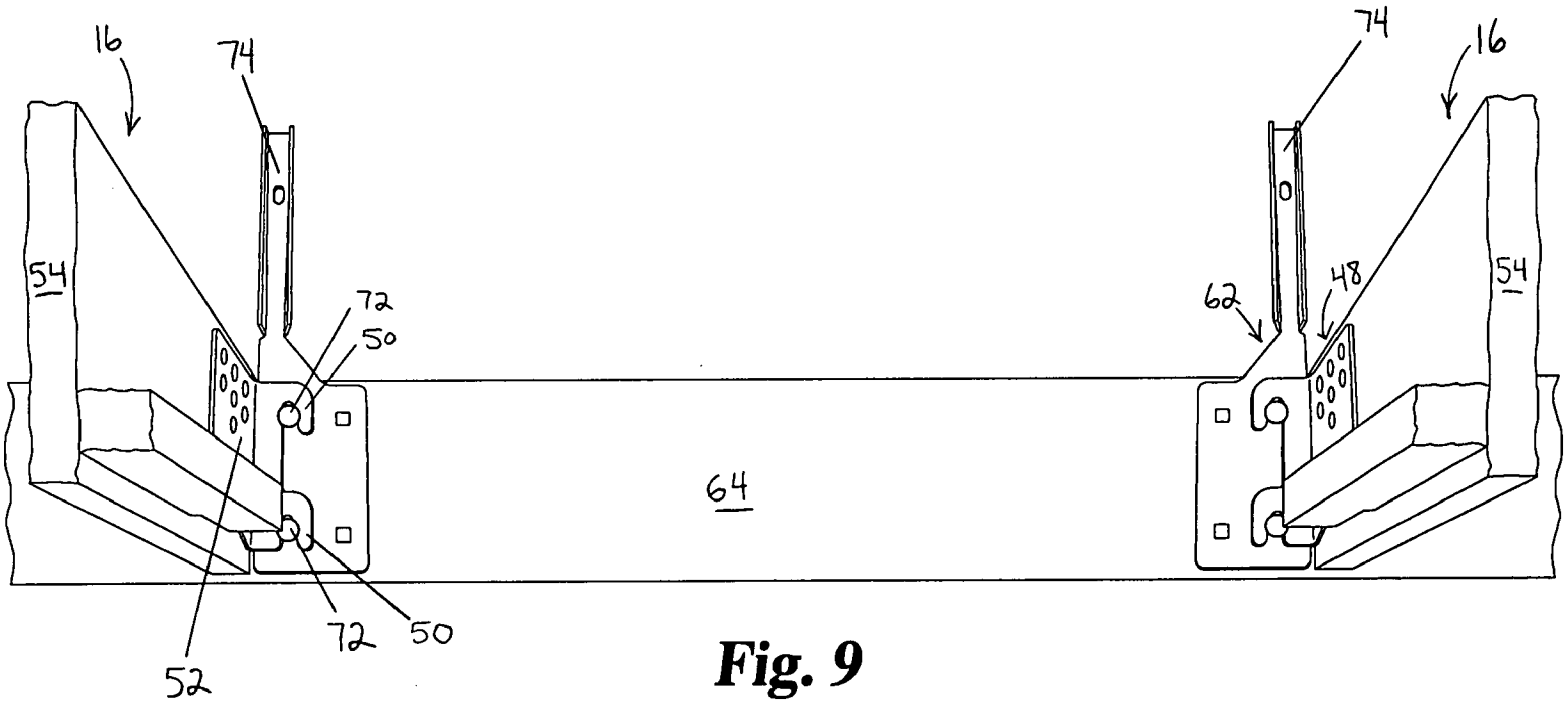
FIG. 9 is a perspective view of the bed rail of FIG. 5 connected to the bed rail with support brackets of FIG. 7.

Bed rail 18, shown in FIGS. 1, 2, and 7, is particularly useful for converting beds into multiple bed units where the beds are connected to one another at right angles at substantially the same elevation. The elongate rail member 56, hook plates 58, and support lip 60 of bed rail 18 are of substantially the same construction as the corresponding parts of bed rail 14. The support brackets 62 are affixed to the outboard side 64 of the rail member 56 by screw fasteners 66 and are spaced apart at a distance appropriate to accommodate the width of a mattress of standard dimensions. Each support bracket 62 is preferably made of metal and has two couplers 68, such as male coupler studs with shanks 70 and buttons 72 extending perpendicular to the broad surface of the bracket, as shown in FIG. 8, for receiving the spaced, downward-opening hooks 50 of the L-shaped hook plates 48 of bed rail 16, as shown in FIG. 9. The hook and stud connection design provides a quick-release connection between bed rails 16 and 18, i.e., a connection that does not require tools to assemble or disassemble the right angle connection, simplifying assembly and use of the bed 10. A channel portion 74 for receiving a guard rail 22 is positioned above the studs 68 so that the guard rails 22 may be supported by bed rails 16 when the bed unit 10 is assembled.

Rails 16 and 18 may use other types and arrangements of quick-release, toolless couplers to connect rail 16 to rail 18 at a right angle, such as, for example, exchanging coupler 48 with coupler 68 so that rail 16 has a male coupler and rail 18 has a female coupler. The male coupler in this example may take the form of a stud, bolt, nail, screw or hook extending from the end of rail 16 that would engage the female coupler of rail 18 that may take the form of, in certain applications, a through hole through the side of rail 18, where support bracket 62 provides a lip covering a portion of the through hole for retaining the stud, bolt, nail, screw or hook in the through hole, or having its upper surface flush with the bottom of the hole for reinforcement of the rail at the connection joint. Alternatively, the female coupler may take the form of an upward-opening hook or an eyelet extending laterally from a side of rail 18.

Figure 10:
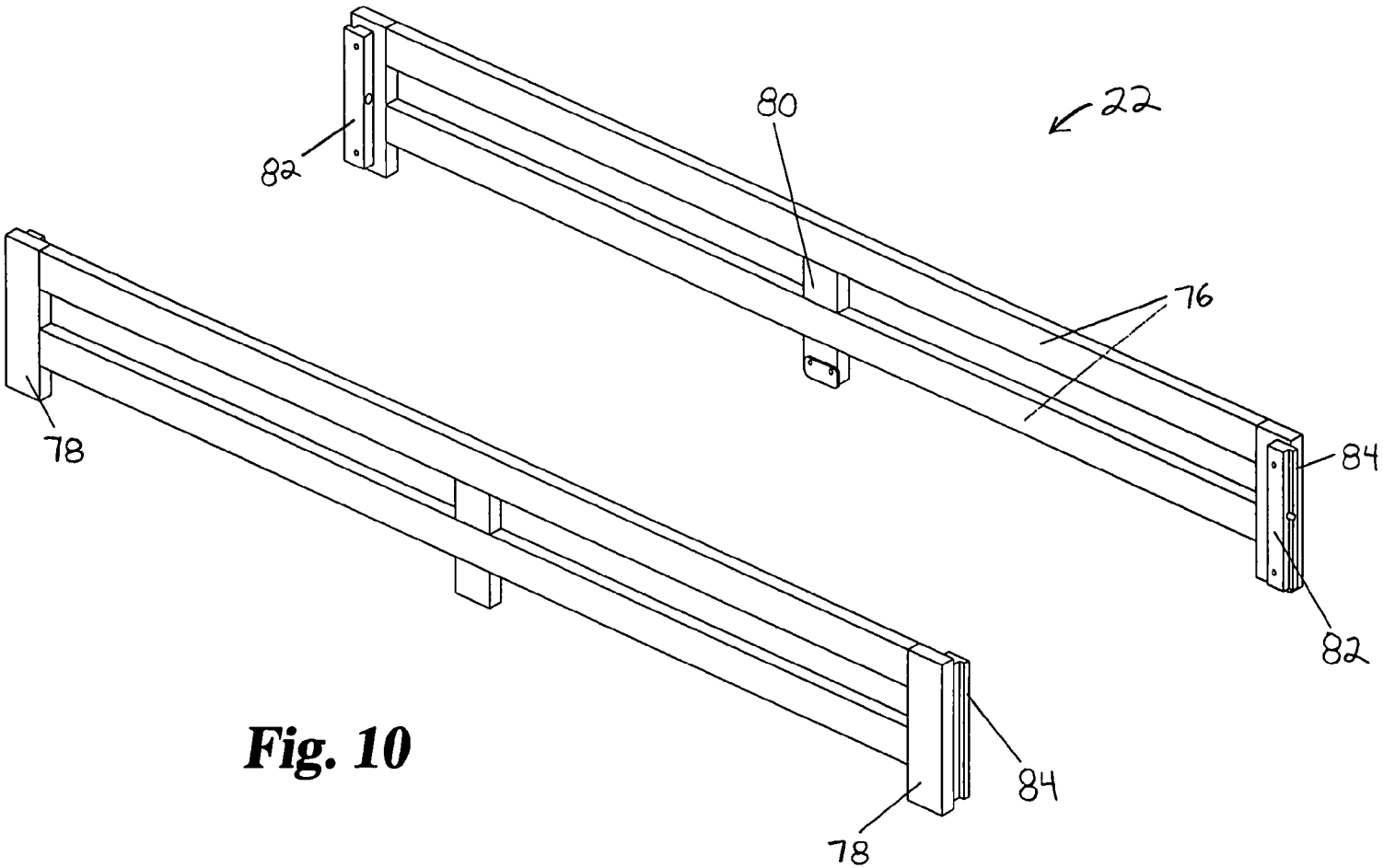
FIG. 10 shows perspective views of the guard rails of FIG. 1.

Each guard rail 22, shown in FIGS. 1, 2 and 10, includes a pair of vertically spaced horizontal rail pieces 76, a pair of end pieces 78, a center brace 80, and a pair of slides 82, one affixed to each end piece 78. The slides 82 are rabbeted to provide a narrow vertical tongue 84 that can be received in the channel portions 74 of the support brackets 62.

Figure 11:
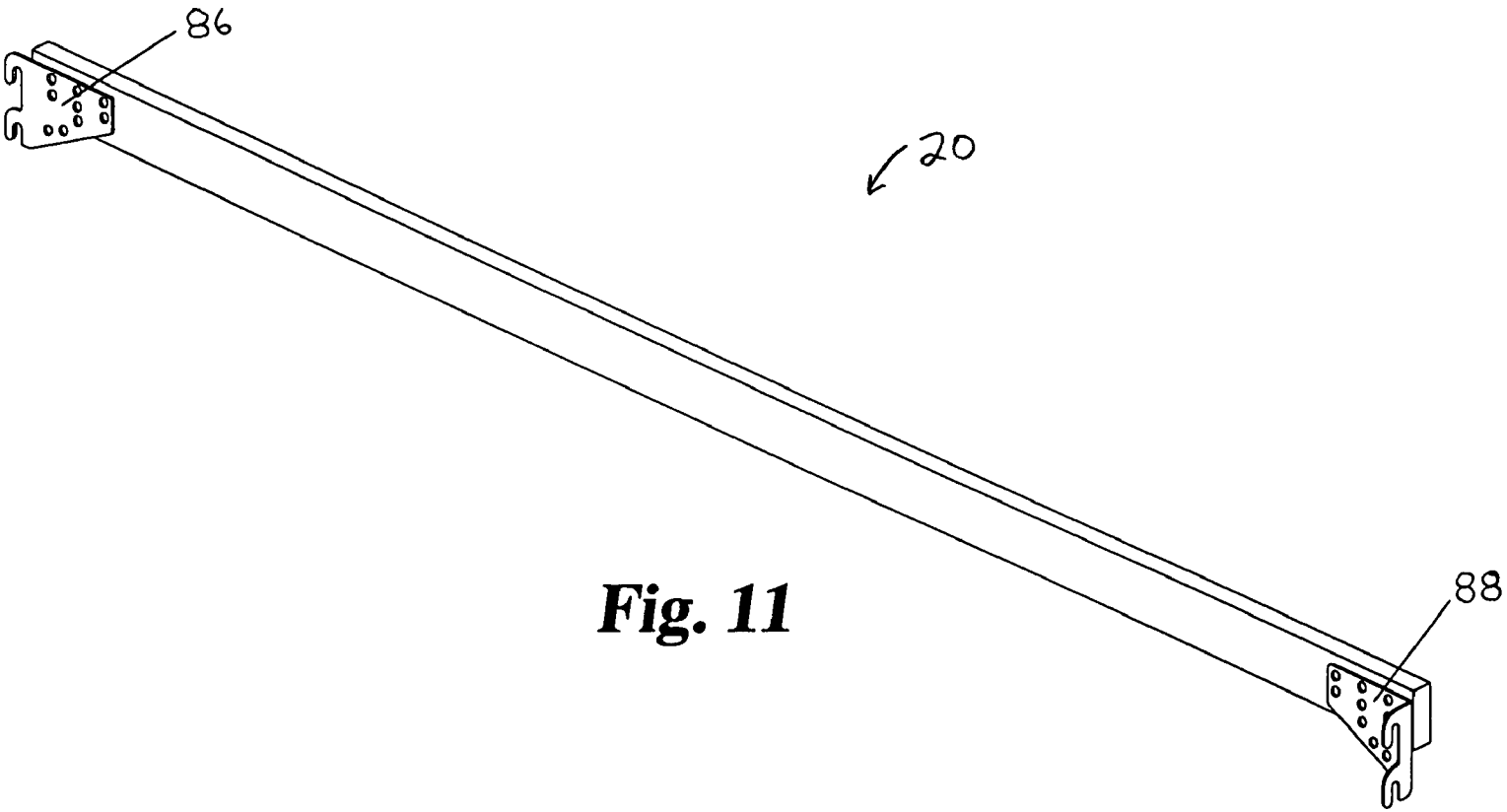
FIG. 11 is a perspective view of the stabilizer of FIG. 1.

The stabilizer rail 20, shown in FIGS. 1, 2 and 11, includes a straight hook plate 86 at one end and an L-shaped hook plate 88 at the opposite end. The stabilizer rail 20 may be used as shown in FIG. 1 where additional stabilization is needed to create a stable, multiple unit bed. Certain multiple unit bed configurations may not require use of a stabilizer rail 20, or may use a stabilizer rail 90 with straight hook plates at both ends, as shown in FIG. 1.

Referring again to FIG. 1, the various components described above are shown assembled to form a multiple bed unit having a first elevated bed A and a second elevated bed B connected to one another at right angles at substantially the same elevation. First, bed A is assembled by connecting a stabilizer rail 90 to a first pair of opposite bed ends 12 that may stand on the floor for the purpose of elevating bed A. The slotted faces of the bed ends face inwardly toward each other.

A bed rail 14 and a bed rail 18 are connected to a second pair of opposite bed ends, with bed rail 14 disposed on the inner side of the bed and the bed rail 18 disposed on the outer side of the bed. As used herein in this context, "inner" and "outer" refer to the sides of the bed that may be adjacent and away from, respectively, a wall of a room. Dowels are placed in the holes at the top of each post 24 of the floor-level bed ends, and the assembled bed A is raised and set upon the lower bed ends with the dowels being received in the holes 32 in the bottom ends of the upper bed ends. The deck slats 92 are then placed on the support lips to span between inner bed rail 14 and outer bed rail 18. The deck slats 92 may be screwed to the support lips. Next, the guard rails 22 can be connected to inner and outer sides of bed A by sliding the tongues 84 downward in the slots 28 of the upper bed ends.

Second bed B is assembled by stacking one bed end above another, using dowels received in holes of the respective bed ends. Then, a pair of bed rails with L-shaped hook plates 16 are attached between the upper bed end and bed rail 18, thereby linking the stacked bed ends to the first bed A. The L-shaped hook plates 48 of bed rails 16 engage the studs 68 of the support brackets 62 as shown in FIG. 9. The deck slats 92 are then placed on the support lips to span between inner and outer bed rails. The deck slats 92 may be screwed to the support lips. Next, the guard rails 22 can be connected to inner and outer sides of bed B by sliding the tongues 84 downward in the slots of the upper bed end and the channel portions 74 of the support brackets 62.

The multiple bed unit 10 of FIG. 1 may be made more useful by connecting a desk surface between the lower bed ends of bed A. In lieu of a desk surface, a third bed may be added by connecting another pair of bed rails between the lower bed ends of bed A, with additional bed slats spanning between the side rails. In addition, a fourth bed may be added by substituting a bed rail with support brackets for one of the bed rails of bed B, and connecting thereto another pair of bed rails and a bed end, with an additional bed end below to elevate the fourth bed. Other combinations of multiple beds are possible by replacing a bed rail with a bed rail with support brackets by which an additional bed may be connected at a right angle to an existing bed, either at the same elevation, e.g. two lower bunks or two elevated bunks, or at different elevations. Co-pending patent application Ser. No. 10/824,764, which application is hereby incorporated by reference, shows other possible configurations of modular multiple bed units. One contemplated configuration has an elevated bunk extending over a lower bunk at a right angle, as described in the above-referenced co-pending application.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A bed rail for a modular multiple bed unit, comprising:

an elongate bed rail with a top surface and a longitudinal axis and with a length appropriate to accommodate the length of a mattress of standard dimensions; and a bracket affixed by a fastener to a side of said elongate bed rail for attaching another bed rail, said bracket having parallel opposite first and second surfaces, said first surface of said affixed bracket lying between said second surface and said side of said elongate bed rail and parallel thereto, said bracket having first and second vertically aligned quick-release couplers fixed to said second surface below said top surface of said elongate bed rail and including a channel portion above said top surface of said elongate bed rail for receiving a guard rail end, wherein each said quick-release coupler is a stud immovably projecting from said second surface and oriented perpendicular to said surfaces of said bracket and to the longitudinal axis of said elongate bed rail.

2. The bed rail of claim 1, wherein the width of said bracket between said parallel surfaces thereof is substantially less than the width of said elongate bed rail;

wherein said channel portion of said bracket extends upwardly and is spaced apart from a top surface of said elongate bed rail; and wherein said channel portion has a pair of flanges projecting horizontally from said second surface of said bracket a distance greater than said width of said bracket.

3. The bed rail of claim 1, wherein said elongate bed rail includes opposed first and second ends, a hook plate affixed to said elongate bed rail proximate said first end and a hook plate affixed to said elongate bed rail proximate said second end, said hook plates each substantially narrower than said elongate bed rail in the direction transverse to said elongate bed rail and configured with a substantially equally narrow, longitudinally projecting hook to readily removably engage a cross-member in a slotted vertical post of a bed frame, and wherein said bracket is affixed approximately midway along the length of said elongate bed rail.

4. The bed rail of claim 3, wherein said elongate bed rail has opposed inboard and outboard sides, said inboard side adapted to support slats, wherein said bracket is affixed to said outboard side and said hook plates are affixed to said inboard side, and wherein the width of said bracket between said parallel surfaces thereof is substantially less than the width of said elongate bed rail.

5. The bed rail of claim 4, further comprising a deck support lip affixed to said inboard side of said elongate bed rail.

6. The bed rail of claim 5, wherein said deck support lip overlies said hook plates of said elongate bed rail.

7. The bed rail of claim 1, wherein said elongate rail is made of wood and said bracket is made of metal.

8. The bed rail of claim 1, wherein said bracket is a first bracket and said bed rail includes a second bracket of like characteristics, affixed to a side of said elongate bed rail and spaced apart from said first bracket a distance appropriate to accommodate the width of a mattress of standard dimensions.

9. The bed rail of claim 8, wherein said first bracket is proximate one end of said bed rail and said second bracket is affixed approximately midway along the length of said bed rail.

10. A modular bed unit, comprising:

a first elongate bed rail with a longitudinal axis, a top surface, opposed inboard and outboard sides, a slat support on said inboard side below said top surface, and a bracket on said outboard side, said bracket having a male quick-release coupler immovably affixed thereto below said top surface, said male quick-release coupler having a shank and a generally circular end portion with a greater diameter than said shank; and a second elongate bed rail of the same length as said first elongate bed rail and adapted to be connected perpendicular to said first elongate bed rail at substantially the same elevation, said second elongate bed rail including a female quick-release coupler immovably affixed on one end thereof for releasably engaging said male quick-release coupler on said outboard side bracket of said first elongate bed rail, wherein said first elongate bed rail includes an upstanding retainer extending above said top surface for retaining one end of a guard rail above said top surface and said quick-release couplers with said quick-release couplers engaged, and with the guard rail extending along said second elongate bed rail.

11. The modular bed unit of claim 10, wherein said retainer comprises a first channel portion for receiving said one end of a guard rail.

12. The modular bed unit of claim 11, further comprising a thin, flat plate having one surface abutting said side of said first elongate bed rail and having a parallel opposite external surface to which said male quick-release coupler is immovably affixed, said plate substantially narrower between said surfaces thereof than said first elongate bed rail;

wherein said female quick-release coupler comprises an L-shaped hook plate having a perpendicular pair of plate portions one of which defines a hook with an open curved shape and a free end for connecting over said male quick-release coupler and which is transverse to and substantially narrower than said second elongate bed rail, said hook extending away from the other plate portion and curving downwardly to a tip otherwise unconnected to the other plate portion.

13. The modular bed unit of claim 12, wherein said male quick-release coupler comprises a stud extending perpendicularly from an outboard side of said first elongate bed rail.

14. The modular bed unit of claim 13, further comprising:

a second male coupler on said side of said first elongate bed rail; and a third elongate bed rail perpendicularly connected to said first bed rail by a second female coupler for engaging said second male coupler.

15. The modular bed unit of claim 14, wherein said second male coupler further comprises a second channel portion for receiving a second guard rail end that is supported by said third elongate bed rail.

16. The modular bed unit of claim 15, further comprising a bed end connecting said second elongate bed rail and said third elongate bed rail.

17. A modular multiple bed unit, comprising:

a first bed having a first pair of bed ends and a pair of bed rails connected between and supported by said bed ends;

a bracket affixed to a side of one of said bed rails, said bracket having a coupler;

a second bed having a third bed end and a second pair of bed rails, one bed rail of said second pair of bed rails connected to said third bed end and perpendicularly connected to said bracket at substantially the same elevation, said one bed rail of said second bed including a second coupler for engaging said coupler;

a second pair of bed ends disposed below said first pair of bed ends to elevate said first bed;

a sixth bed end disposed below said third bed end to elevate said second bed; and a stabilizer rail connected between said sixth bed end and one of said second pair of bed ends, said stabilizer rail including an L-shaped hook plate for engaging a rail connector of said one of said second pair of bed ends at a right angle;

wherein said second bed includes a guard rail on said one bed rail, and wherein said bracket on said first bed includes a channel portion for receiving an end of said guard rail.

18. The modular multiple bed unit of claim 17, wherein said first bed includes a pair of guard rails disposed between the bed ends thereof.

19. A modular multiple bed unit, comprising:

a first bed having a first pair of bed ends and a pair of bed rails connected between and supported by said bed ends;

a bracket affixed to a side of one of said bed rails, said bracket having a coupler;

a second bed having a third bed end and a second pair of bed rails, one bed rail of said second pair of bed rails connected to said third bed end and perpendicularly connected to said bracket at substantially the same elevation, said one bed rail of said second bed including a second coupler for engaging said coupler, a second pair of bed ends disposed below said first pair of bed ends to elevate said first bed;

a sixth bed end disposed below said third bed end to elevate said second bed; and a stabilizer rail connected between said sixth bed end and one of said second pair of bed ends, said stabilizer rail including an L-shaped hook plate for engaging a rail connector of said one of said second pair of bed ends at a right angle;

wherein said first bed includes a pair of guard rails disposed between the bed ends thereof; and wherein said bracket further comprises a channel portion for receiving a guard rail end.

20. The modular multiple bed unit of claim 19, further comprising a third guard rail supported by said bed rail connected between said third bed end and said bracket, an end of said third guard rail engaged with said channel portion of said bracket.

21. A modular multiple bed unit, comprising:

a first bed having a first pair of bed ends and a pair of bed rails connected between and supported by said bed ends, said rails each having a top surface, a bottom surface, an inboard side and an outboard side and further having a connector on each end configured for readily removable attachment to one of said bed ends;

first and second brackets affixed by respective fasteners to an external surface of said outboard side of a first of said rails, each bracket having first and second vertically aligned studs that are immovable with respect thereto, each stud extending perpendicularly outward from said outboard side of said first rail at a level below said top rail surface and above said bottom rail surface, one of said brackets located adjacent to one of said end connectors and the other located approximately midway along the rail length; and a second bed having a third bed end and a second pair of bed rails connected on one end thereto, the opposite end of each rail of said second bed connected perpendicularly to said outboard side of said first rail at substantially the same elevation by means of a mating coupler coupled to a respective one of said studs.

22. The modular multiple bed unit of claim 21, wherein each said mating coupler comprises an L-shaped hook plate with a hook for engaging its respective stud, said hook lying in a plane parallel to the outboard side of said first rail.

23. The modular multiple bed unit of claim 22, wherein said pairs of bed rails are made of wood and said bracket is made of metal.

24. A modular multiple bed unit, comprising:

a first bed having a first pair of bed ends and a pair of bed rails connected between and supported by said bed ends, said rails each having a top surface, an inboard side and an outboard side and further having a connector on each end configured for readily removable attachment to one of said bed ends, each said inboard side adapted to support slats;

first and second brackets affixed by respective fasteners to an external surface of said outboard side of a first of said rails, each bracket having a quick-release coupler that is immovable with respect thereto, below said top rail surface, one of said brackets located adjacent to one of said end connectors and the other located approximately midway along the rail length;

a second bed having a third bed end and a second pair of bed rails connected on one end thereto, the opposite end of each rail of said second bed connected perpendicularly to said outboard side of said first rail at substantially the same elevation by means of a mating quick-release coupler immovably affixed on said opposite end and coupled to a quick-release coupler of a respective one of said brackets;

wherein each said bracket further comprises an integral open-sided channel above said top rail surface for retaining one end of a guard rail disposed above and extending along a respective one of said rails of said second bed, and wherein each said channel is an elongate vertical channel with a U-shaped horizontal cross section the open side of which is oriented parallel to said first rail; and a guard rail having an elongate vertical tongue on one end contained within said elongate vertical channel and extending vertically substantially the full height thereof.

25. The modular multiple bed unit of claim 24, wherein the quick-release coupler of each said bracket is a stud;

wherein each said bracket comprises a thin, flat plate having one surface abutting said outboard side of said first rail and having a parallel opposite external surface to which said stud is immovably affixed, said plate substantially narrower between said surfaces thereof than said first rail; and wherein each said channel extends vertically above its respective plate and has a pair of flanges projecting horizontally from said plate a distance greater than said plate width.

26. The modular multiple bed unit of claim 25, wherein the quick-release coupler on each rail of said second bed comprises a hook with an open curved shape and a free end for connecting over its respective stud, and wherein each said hook is transverse to the rail of said second bed to which it is affixed.

27. The modular multiple bed unit of claim 24, wherein the quick-release coupler of each said bracket is a female coupler; and wherein the quick-release coupler on each rail of said second bed is a stud which extends from the end of its rail and is perpendicular to a broad surface of its respective bracket.

28. The modular multiple bed unit of claim 27, wherein each said female coupler is a hook for engaging its respective stud.

* * * * *